US007793640B2

(12) United States Patent
Fach et al.

(10) Patent No.: US 7,793,640 B2
(45) Date of Patent: Sep. 14, 2010

(54) METHOD AND DEVICE FOR OPERATING AN INTERNAL COMBUSTION ENGINE

(75) Inventors: Heiko Fach, Herbertshausen (DE); Carlos Eduardo Migueis, Tegernheim (DE); Till Scheffler, München (DE)

(73) Assignee: Continental Automotive GmbH, Hannover (DE)

( * ) Notice: Subject to any disclaimer, the term of this patent is extended or adjusted under 35 U.S.C. 154(b) by 283 days.

(21) Appl. No.: 12/030,091

(22) Filed: Feb. 12, 2008

(65) Prior Publication Data

US 2008/0201061 A1 Aug. 21, 2008

(30) Foreign Application Priority Data

Feb. 16, 2007 (DE) ..... 10 2007 007 815

(51) Int. Cl.
*F02M 51/00* (2006.01)
*F02M 51/06* (2006.01)

(52) U.S. Cl. ..... 123/479

(58) Field of Classification Search ..... 123/478, 123/479, 480, 490, 494, 359; 701/103, 104, 701/105, 111

See application file for complete search history.

(56) References Cited

U.S. PATENT DOCUMENTS 5,778,852 A * 7/1998 Penteker ..... 123/359
6,450,158 B2 * 9/2002 Takahashi et al. ..... 123/681

* cited by examiner

*Primary Examiner*—Mahmoud Gimie
(74) *Attorney, Agent, or Firm*—King & Spalding L.L.P.

(57) ABSTRACT

An injection valve of an internal combustion engine is actuated at least once by at least one specified control value of an actuating variable for metering at least one specified minimum quantity corrected by a correction value. The correction value for the control value is adjusted according to a deviation of an expected response value of an actuating variable from an actual response value of the response variable, as a result of the actuation of the respective injection valve, that is to say by way of a reduction of the deviation between the expected response value of the response variable and the actual response value of the response variable. If the correction value undershoots a specified negative correction threshold value or overshoots a specified positive correction threshold value, a fault is detected in a component which is affecting the exhaust gas in the cylinder assigned to the respective injection valve.

16 Claims, 3 Drawing Sheets

METHOD AND DEVICE FOR OPERATING AN INTERNAL COMBUSTION ENGINE

CROSS-REFERENCE TO RELATED APPLICATIONS

This application claims priority to German Patent Application Number 10 2007 007 815.5 filed on Feb. 16, 2007, and which is incorporated herein by reference in its entirety.

TECHNICAL FIELD

The invention relates to a method and a device for operating an internal combustion engine having a plurality of cylinders and injection valves assigned thereto for metering fuel into a combustion chamber of the respective cylinder.

BACKGROUND

Increasingly stringent legal requirements with regard to permissible pollutant emissions of automobiles in which internal combustion engines are fitted, make it necessary to keep the pollutant emissions as low as possible when the internal combustion engine is running. On the one hand, this can be achieved by reducing pollutant emissions which are produced during the combustion of the air/fuel mixture in the respective cylinder of the internal combustion engine. On the other hand, exhaust gas aftertreatment systems that convert the pollutant emissions produced during the air/fuel mixture combustion process in the respective cylinders into harmless substances, are used in internal combustion engines. Catalytic converters, which convert carbon monoxide, hydrocarbons and nitrogen oxide into harmless substances are used for this purpose. The specific effects of the production of pollutant emissions during combustion, and the highly efficient conversion of the pollutant components by a catalytic converter, both demand a very precisely-set air/fuel ratio in the respective cylinder.

With regard to an actual, suitably-low pollutant emission while the vehicle is being operated, requirements regarding a diagnosis of various components assigned to the internal combustion engine play an increasingly important role. For example, it is stipulated in a draft of the California Air Regulation Board (CARB 1968.2 Annex A(e), 6.2.1 (C), of Sep. 8, 2006) that an imbalance in an air/fuel ratio in one cylinder or in several cylinders, due to a cylinder-specific malfunction, that may be present in the region of the fuel injection valve for example, must be detected.

SUMMARY

According to an embodiment, a method for operating an internal combustion engine having a plurality of cylinders, and injection valves assigned thereto for metering fuel into a combustion chamber of the respective cylinder, may comprise the steps of:—actuating a respective injection valve at least once by at least one specified control value of an actuating variable for metering at least one specified minimum quantity corrected by a correction value,—adjusting the correction value according to a deviation of an expected response value of a response variable from an actual response value of the response variable as a result of the actuation of the respective injection valve wherein the adjustment is effected by way of a reduction in the deviation between the expected response value of the response variable and the actual response value of the response variable,—if the correction value undershoots a specified negative correction threshold value or overshoots a specified positive correction threshold value, detecting a fault in a component which is affecting the exhaust gas of the cylinder assigned to the respective injection valve.

According to another embodiment, a method for operating an internal combustion engine having a plurality of cylinders and injection valves assigned thereto, for metering fuel into a combustion chamber of the respective cylinder, may comprise the steps of:—actuating the respective injection valve at least once by at least one specified control value of a control variable for metering at least one specified minimum quantity,—determining a deviation of an expected response value of a response variable from an actual response value of the response variable as a result of the actuation of the respective injection valve, and—if the deviation undershoots a specified negative response threshold value or overshoots a specified positive response threshold value, detecting a fault in a component which is affecting the exhaust gas of the cylinder assigned to the respective injection valve.

According to a further embodiment, the response variable may represent a torque or a change of torque. According to a further embodiment, the response variable may represent a pressure change in the fuel pressure in a fuel supply system of the injection valve. According to a further embodiment, the response variable may represent an air/fuel ratio of a mixture in the respective cylinder, that is to say before the combustion of the mixture. According to a further embodiment, the response variable may represent a rough-running value that is representative of a rough-running condition in a drive shaft of the internal combustion engine. According to a further embodiment, the specified actuating variable may represent an injection time period. According to a further embodiment, the actuation of the injection valve by the specified control value or the specified control value corrected by means of the correction value, and the determination of the deviation may take place in an overrun condition of the internal combustion engine. According to a further embodiment, the actuation of the injection valve by the specified control value or the specified control value corrected by means of the correction value, respectively, and the determination of the deviation may take place in an idling condition.

According to yet another embodiment, a device for operating an internal combustion engine may comprise a plurality of cylinders and injection valves assigned thereto for metering fuel into a combustion chamber of the respective cylinder, the device being operable—to actuate the respective injection valve at least once by at least one specified control value of an actuating variable for metering at least one specified minimum quantity corrected by means of a correction value,—to adjust the correction value according to a deviation of an expected response value of a response variable from an actual response value of the response variable as a result of the actuation of the respective injection valve, by way of a reduction of the deviation between the expected response value of the response variable and the actual response value of the response variable,—if the correction value undershoots a specified negative correction threshold value or overshoots a specified positive correction threshold value, to detect a fault in a component which is affecting the exhaust gas of the cylinder assigned to the respective injection valve.

According to yet another embodiment, a device for operating an internal combustion may comprise a plurality of cylinders, and injection valves assigned thereto, for metering fuel into a combustion chamber of the respective cylinder, the device being operable—to actuate the respective injection valve at least once by at least one specified control value of an actuating variable for metering at least one specified minimum quantity;—to determine a deviation of an expected response value of a response variable from an actual response value of the response variable as a result of the actuation of the respective injection valve, and—if the deviation undershoots a specified negative response threshold value or overshoots a specified positive response threshold value, to detect a fault in a component that is affecting the exhaust gas of the cylinder assigned to the respective injection valve.

According to the various embodiments, a method and a device for operating an internal combustion engine can be provided, which method and device facilitate simple and reliable detection of a fault in a component that is affecting the exhaust gas of the cylinder assigned to the respective injection valve.

BRIEF DESCRIPTION OF THE DRAWINGS

Exemplary embodiments of the invention are explained in detail below with the aid of the schematic drawings, of which.

Elements having identical construction or function are denoted in all drawings with identical reference numbers.

DETAILED DESCRIPTION

Figure 1:
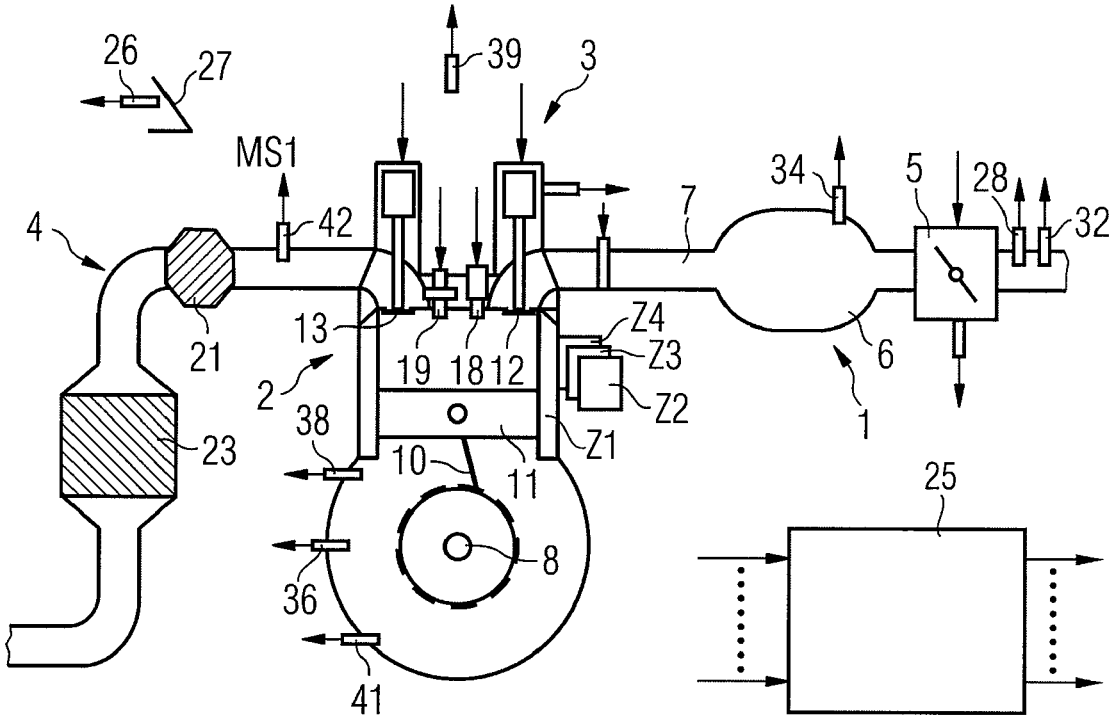
FIG. 1 shows an internal combustion engine with a control device.

According to a first aspect, a method and a corresponding device for operating an internal combustion engine may have a plurality of cylinders and injection valves assigned thereto, for metering fuel into a combustion chamber of the respective cylinder. The respective injection valve is actuated at least once by at least one specified control value of an actuating variable for metering at least one specified minimum quantity corrected by means of a correction value. The correction value for the control value of the actuating variable is adjusted according to a deviation of an expected response value of a response variable from an actual response value of the response variable, as a result of the actuation of the respective injection valve. The adjustment of the correction value is effected by way of a reduction in the deviation between the expected response value of the response variable and the actual response value of the response variable.

If the correction value undershoots a specified negative correction threshold value or overshoots a specified positive correction threshold value, a fault is detected in a component which is affecting the exhaust gas of the cylinder assigned to the respective injection valve. In this way, detection of a fault in the component that is affecting the exhaust gas of the cylinder assigned to the respective injection valve, is particularly simple and reliable, and in fact particularly by dual use, if necessary, of the existing functionality to determine the correction value for the specified control value of the actuating variable within the context of a precise metering of the specified minimum quantity. The correction value can therefore also be used to advantage for the precise metering of the specified minimum quantity during a warm-up phase of a catalytic converter, promptly at the start-up of the internal combustion engine.

According to a second aspect, in a method and a device for operating the internal combustion engine, the respective injection valve is actuated at least once by at least one specified control value of the actuating variable for metering at least one specified minimum quantity, and a deviation of an expected response value of a response variable from an actual response value of the response variable is determined as a result of the actuation of the respective injection valve.

If the deviation undershoots a specified negative response threshold value or overshoots a specified positive response threshold value, a fault that is affecting the exhaust gas of the cylinder assigned to the respective injection valve is detected. Detection of a fault in one of the components that is affecting the exhaust gas of the cylinder assigned to the respective injection valve (18) is therefore possible with relatively little computing effort.

According to an embodiment, the response variable represents a torque or a change in torque. The knowledge that, caused by the specified control value of the actuating variable in the fault-free case of the respective component, a foreseeable torque or also a foreseeable change of torque could be caused by the combustion of the air-fuel mixture thus produced in the respective cylinder, is used in this way. Furthermore, the torque or change of torque determined in this way can also be used for other purposes in the context of an internal combustion engine controller, and therefore has numerous uses.

According to a further embodiment, the response variable represents a pressure change in the fuel pressure in a fuel supply system of the injector valve. The knowledge that the metering of the specified minimum quantity, with correct actual metering of this minimum quantity, results in an easily determined variation in the pressure of the fuel in the fuel supply system, is used in this way. This can be detected, for example, by means of a pressure sensor for detecting the fuel pressure, which is normally fitted anyway, and thus determined without additional expenditure on sensor technology. In this connection it may be particularly advantageous if the actuation of the respective injection valve by the control value for metering the specified minimum quantity—if necessary corrected by means of the correction value—is carried out with regard to the detection of the fault in the respective injection valve if the internal combustion engine is operated in an overrun condition.

In the overrun condition, the fuel metering to the respective cylinders is usually cut off and, especially for the purpose of detecting faults in the injection valve, it is therefore possible to meter fuel into only one or only into individual cylinders of the internal combustion engine. Changes in fuel pressure can then be very accurately correlated to the respective amount of fuel metered by the respective injection valve.

This therefore also makes for reliable detection of a fault in an individual injection valve if assignment of the respective air/fuel ratio to an individual cylinder is difficult because of design constraints, which can be the case when a turbocharger, whose turbine is often positioned upstream of an exhaust gas probe in the exhaust gas tract, is used for example, and contributes to swirl in exhaust gas packets that are assigned to different cylinders.

According to a further embodiment, the response variable represents an air/fuel ratio of a mixture in the respective cylinder, that is to say before the combustion of the mixture. The fault in the respective component can be determined in this way by using sensor technology that is normally available. In this connection it may be particularly advantageous if, by suitable signal processing, a variable representing the respective air/fuel ratio can be assigned to individual cylinders. In this connection, an analysis of the variable representing the air/fuel ratio of the mixture in the respective cylinder when the internal combustion engine is idling, may be particularly advantageous.

According to a further embodiment, the response variable represents a rough-running value that is representative of a rough-running condition in a drive shaft of the internal combustion engine. In this way, detection of the fault in the respective component can also be particularly simple to achieve. Furthermore, particularly where, due to design constraints, it is difficult to assign the gas probe metering signal in the exhaust gas tract, representing the respective air/fuel ratio, to the respective, individual mixture distributions in the cylinders, reliable detection of the fault is nevertheless also possible. In this connection, it may be particularly advantageous if the deviation of the expected response value from the actual response value is determined in the overrun operating condition, it then being preferable in each case for only one individual cylinder or only individual cylinders to be operated in the context of fuel metering during the respective combustion cycle, and thus the rough-running condition is particularly characteristic of the respective cylinder or the respective, individual cylinders, and the fault in the respective component can therefore be detected with high precision. Furthermore, it may be particularly advantageous if the rough-running value is determined for individual cylinders.

Moreover, it may be particularly advantageous if the actuating variable represents an injection time period.

It can be advantageous if the actuation of the injection valve by the specified control value or the specified control value corrected by means of the correction value, respectively, and the determination of the deviation, take place in an overrun condition of the internal combustion engine. In the overrun condition the deviation has a particularly strong correlation to the actual injection characteristic of the injection valve each time it is actuated, without further influencing variables having a decisive effect on the deviation.

According to a further embodiment, the actuation of the injection valve by the specified control value or the specified control value corrected by means of the correction value, respectively, and the determination of the deviation take place in the idling condition.

An internal combustion engine (FIG. 1) has an induction tract 1, an engine block 2, a cylinder head 3 and an exhaust gas tract 4. Preferably, the induction tract 1 has a throttle valve 5, and in addition a manifold 6 and an induction manifold 7, that is led to a cylinder Z1 via an intake port in the engine block 2. Furthermore, the engine block 2 has a crankshaft 8, which is coupled via a connecting rod 10 to the piston 11 of the cylinder Z1.

The cylinder head 3 has a valve actuating mechanism with a gas inlet valve 12 and a gas exhaust valve 13.

Furthermore, the cylinder head 3 has an injection valve 18 and a spark plug 19. Alternately, the injection valve 18 can also be positioned in the induction manifold 7.

A catalytic converter 21, preferably designed as a three-way catalytic converter, is positioned in the exhaust gas tract. Furthermore, a further catalytic converter 23 that is designed as a Nox catalytic converter is preferably positioned in the exhaust gas tract.

A control device 25 is provided, to which sensors are assigned to detect the various measured variables and in each case determine the value of the measured variable. In addition to measured variables, operating variables also include variables derived from these. Dependent on at least one of the operating variables, the control device 25 determines manipulated variables which are then converted into one or more control signals for controlling the final control elements by means of suitable actuators. The control device 25 can also be described as a device for operating the internal combustion engine.

The sensors are a pedal position transmitter 26, which detects a gas pedal position of a gas pedal 27, an air mass sensor 28, which detects an air mass flow upstream of the throttle valve 5, a first temperature sensor 32, which detects an intake air temperature, an induction manifold pressure sensor 34, which detects an induction manifold pressure in the manifold 6, a crankshaft angle sensor 36, which detects a crankshaft angle to which a rotational speed is then assigned.

Furthermore, a second temperature sensor 38 is provided, which detects an operating temperature, in particular a coolant temperature or a fuel temperature. In addition, a pressure sensor 39 is provided, which detects a fuel pressure, in particular in a high-pressure reservoir of a fuel supply. Furthermore, a torque sensor 41 can also be provided, that detects a torque which is generated by the internal combustion engine, and which in particular is output at the drive end.

Furthermore, an exhaust gas probe 42 is provided, which is positioned upstream of or in the catalytic converter 42 and which detects the residual oxygen content of the exhaust gas and whose measurement signal MS1 characterizes the air/fuel ratio in the combustion chamber of the cylinder Z1, and upstream of the first exhaust gas probe before oxidation of the fuel, described below as the air/fuel ratio in the cylinders Z1-Z4.

The exhaust gas probe 42 is preferably a linear lambda probe, but in principle it can also be a binary lambda probe.

Depending on the embodiment, any subset of the stated sensors can be provided, or additional sensors can also be provided.

The final controlling elements are, for example, the throttle valve 5, the gas inlet and gas exhaust valves 12, 13, the injection valve 18 or the spark plug 19.

Besides the cylinder Z1, further cylinders Z2 to Z4 are also provided, to which corresponding final control elements and if necessary, sensors are also then assigned. Consequently, the internal combustion engine can have any number of cylinders.

In principle, the internal combustion engine can also have a plurality of cylinder banks, for example, two cylinder banks, a separate first exhaust gas probe 42 being assigned to each one of them. Preferably in this case each of the following embodiments then applies with reference to the respective cylinder bank.

Preferably, the control device includes a memory to store programs and/or data. Furthermore, a processing unit is provided, which includes a microprocessor, for example, in which the program or programs are executed during the operation of the internal combustion engine.

A first program for operating the internal combustion engine is explained in detail below with the aid of the flow chart in FIG. 2. The program is started in step S1, in which variables can be initialized if necessary. The start can be implemented promptly at the start-up of the internal combustion engine, for example. However, it can also be effected, for example, during a specified operating state of the internal combustion engine, such as an idling condition or overrun condition of the internal combustion engine.

A control value CTRL_KM of an actuating variable for metering a specified minimum quantity is determined in step S2. The control value CTRL_KM can be specified as the default value, for example. However, it can also depend on an operating variable, such as the fuel pressure or a temperature, for example. The actuating variable can be an injection time period, for example, to which an injection time value TI_KM is then assigned for metering the specified minimum quantity. The actuating variable can, however, also be another variable known to the competent person skilled in the art for actuating the injection valve, such as electrical power to be supplied, for example, in particular in conjunction with a possible existing solid state actuator for operating the injector valve 18.

In step S2 the respective injection valve 18 is actuated by the specified control value CTRL_KM. Preferably, the program in FIG. 2 is executed with regard to the injection valves 18 assigned to the various cylinders Z1 to Z4 individually in each case. Provision can be made here for each program to be executed chronologically one after the other for the individual cylinders and in each case executed for the following cylinder only if either the injection valve 18 assigned to the respective cylinder has been detected as faulty or another condition has occurred, for example a specified number of program runs has been completed and no fault has been detected. In principle, however, the program in FIG. 2 can also be executed virtually in parallel for several cylinders and in particular also for every two cylinders that are assigned to different exhaust banks.

In step S4, resulting from the actuation of the respective injection valve 18, an actual response value REAK_AV of a response variable is determined by the control value CTRL_KM of the actuating variable. In addition, in step S4, resulting from the actuation of the respective injection valve 18, an expected response value REAK_SP of the response variable is determined by the control value CTRL_KM, which can be specified as the default value, for example, but can also be dependent upon at least one operating variable.

The response variable can represent a torque or a change of torque, for example, as shown in step S16, and actually with regard to the torque that is output by the internal combustion engine, that is in particular the torque that is output at the drive end. In this case, the actual response value then corresponds to an actual torque value TQ_AV, for example, and the expected response value REAK_SP corresponds to an expected torque value TQ_SP, or in the case of the torque change, the expected response value REAK_SP corresponds to an expected torque change value TQ_D_SP and the actual response value REAK_AV corresponds to an actual torque change value TQ_D_AV.

If the response variable represents a pressure change in fuel pressure in a fuel supply system of the injection valve 18, then an actual pressure change value P_FUEL_D_AV is assigned to the actual response value and an expected pressure change value P_FUEL_D_SP is assigned to the expected response value REAK_SP.

If the response variable represents an air/fuel ratio of a mixture in the respective cylinder, that is to say before the combustion of the mixture, then an expected lambda value LAMB_SP is assigned to the expected response value REAK_SP and an actual lambda value LAMB_AV is assigned to the actual response value REAK_AV. If the response variable represents a rough-running value that is representative of a rough-running condition in a drive shaft of the internal combustion engine, then an expected rough-running value LU_SP is assigned to the expected response value REAK_SP and an actual rough-running value LU_AV is assigned to the actual response value REAK_AV.

In particular, when the program is executed in the overrun condition of the internal combustion engine, that is in particular steps S2 and S4, the respective response value REAK_AV, largely free from interference effects due to other cylinders, can be determined from the injection valve just actuated for metering the minimum quantity and from this assigned cylinder.

In addition, the execution of the program also facilitates a particularly precise assignment to the respective injection valve 18 and thus to the respective cylinders Z1 to Z4 assigned to it, that is to say in particular steps S2 and S4 during the idling condition, in particular in connection with the response variable representing the air/fuel ratio of the mixture in the respective cylinders Z1 to Z4.

A deviation DELTA in the expected and in the actual response value REAK_SP, REAK_AV is then determined in step S6.

In a step S8 a check is made as to whether the deviation DELTA is greater than a specified positive response threshold value R_THD_POS, which is preferably determined by suitable tests or simulations in such a way that its overshoot is characteristic of the presence of the fault ERR in the respective injection valve 18.

If the condition of step S8 is met, then in step S10 a fault ERR is detected in a component affecting the exhaust gas of the cylinder assigned to the respective injection valve 18. The fault ERR can, for example, be input into a fault memory or also signaled directly to a driver. The component can be, for example, the injection valve (18), a spark plug (19) assigned to the respective cylinder, a valve actuating mechanism assigned to the respective cylinder or an exhaust gas recirculation channel or annular valve seat.

Following step S10, processing is continued in step S12 in which the program pauses for a specified waiting time T_W, before processing is again continued in step S2. The waiting time T_W can be specified, for example, so that steps S2 to S8, or step S14, are each executed once during one combustion cycle of the internal combustion engine.

If, on the other hand, the condition of step S8 is not met, then a check is made in step S14 as to whether the deviation DELTA is smaller than a specified negative response threshold value R_THD_NEG. If the condition of step S14 is met, then processing is continued in step S10. If, however, the condition of step S14 is not met, then processing is continued in step S12, but it can also be ended if, for example, the program has run for a specified number of cycles since its start and, for example, step S10 was not executed.

A second program that, just like the first program, can be executed during the operation of the control device, can alternately or additionally be stored in the memory of the control device 25. In particular, the differences between this program and the first program are explained in detail below. The second program is started in step S20, in which variables can also be initialized if required.

The control value CTRL_KM of the actuating variable for metering the specified minimum quantity is determined in step S22 and furthermore a correction value COR is read in, whose adjustment is explained in detail further on. The respective injection valve is then actuated by the control value CTRL_KM corrected by means of the correction value COR. Just like in the flow chart in FIG. 2, the control value CTRL_KM can, for example, be the injection time value TI_KM.

Step S24 then corresponds to step S4, also taking into account step S36 which corresponds to step S16.

In addition to the procedure in step S6, the correction value COR is adjusted in step S26. This is preferably achieved in accordance with a previously valid value of the correction value COR and the deviation DELTA. This can be filtered, for example, by generating a moving average in which a specified portion of the deviation DELTA is taken in each case for the correction value COR. However, it can also be achieved in any other appropriate way, as is known to the competent person skilled in the art, in particular in the context of adaptations.

In a step S28 a check is then made as to whether the correction value COR is greater than a specified positive correction threshold value COR_THD_POS. If this is the case, then in step S30 the fault ERR is detected in the component which is affecting the exhaust gas of the cylinder assigned to the respective injection valve (18). In this respect, step S30 corresponds to step S10.

If, on the other hand the condition of step S28 is not met, then a check is made in step S34 as to whether the correction value COR is smaller than a specified negative correction threshold value COR_THD_NEG. If the condition of step S34 is met, then processing in step S30 is continued and the fault ERR in the respective component is detected. If the condition of step S34 is not met, then processing is continued in step S32, in which the program pauses for the specified waiting time T_W corresponding to step S12. Like the one in FIG. 2, the program in FIG. 3 can likewise be ended when the conditions stated there are present.

Preferably, all the positive and negative correction threshold values COR_THD_POS, COR_THD_NEG and the positive and negative response threshold values R_THD_POS, R_THD_NEG are suitably determined by tests or simulations so that the presence or absence of the fault ERR in the respective component can be detected by checking the conditions in the respective steps S8, S14, S28 and S34.

A minimum quantity is, for example, a minimum quantity of fuel that is to be metered, for example in the context of an after-injection in order to warm up the catalytic converter 21 promptly at the start-up of the internal combustion engine. It can, for example, amount to approximately 2 mg, but this depends on the injection valve 18 that is used at any one time. The minimum quantity can also have different values. In particular, with reference to each cylinder, the minimum quantity can be metered several times within one combustion cycle and therefore the injection valve can be actuated several times by the control values CTRL_KM of the actuating variable.

Figure 2:
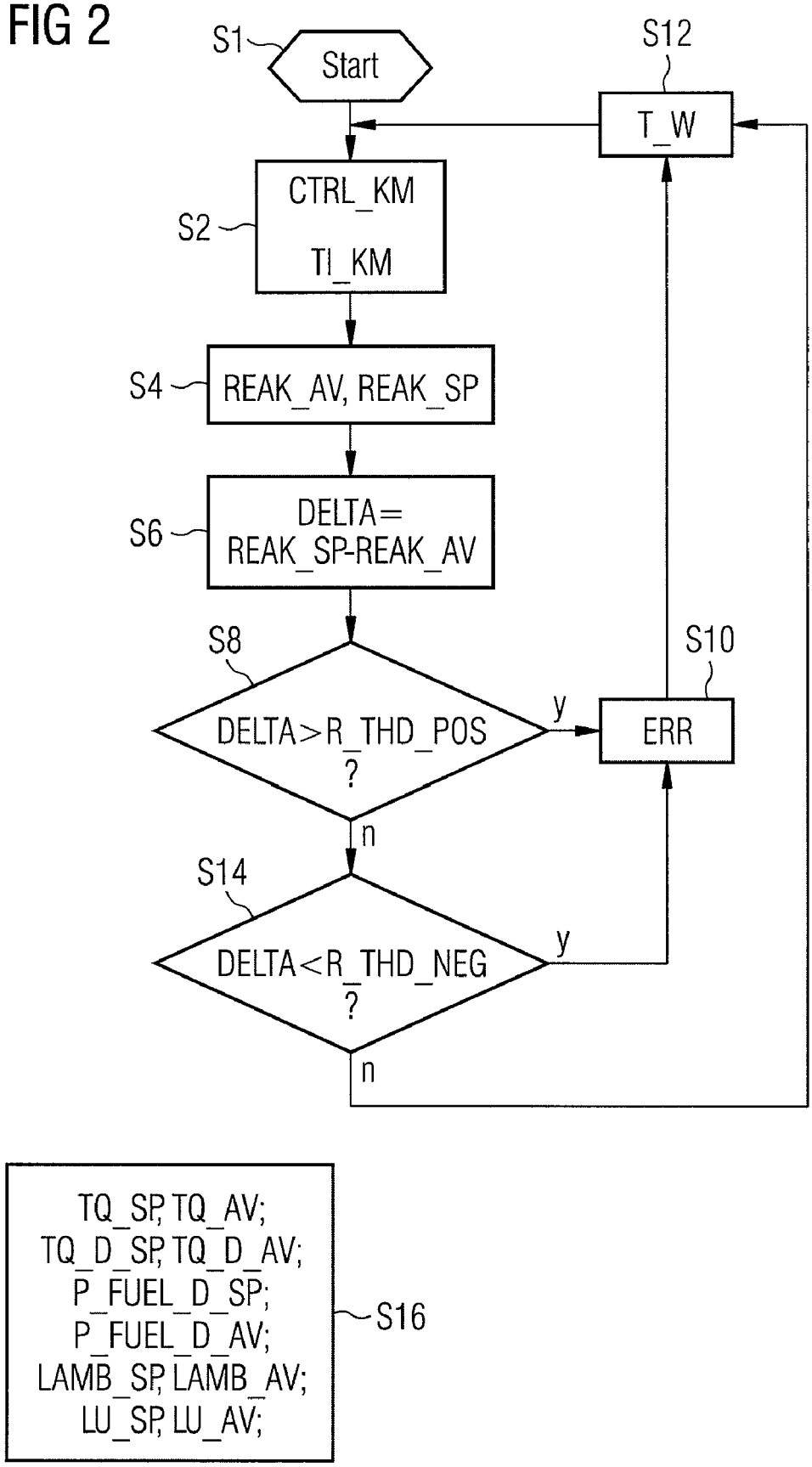
FIG. 2 shows a flow chart of a first program.
Figure 3:
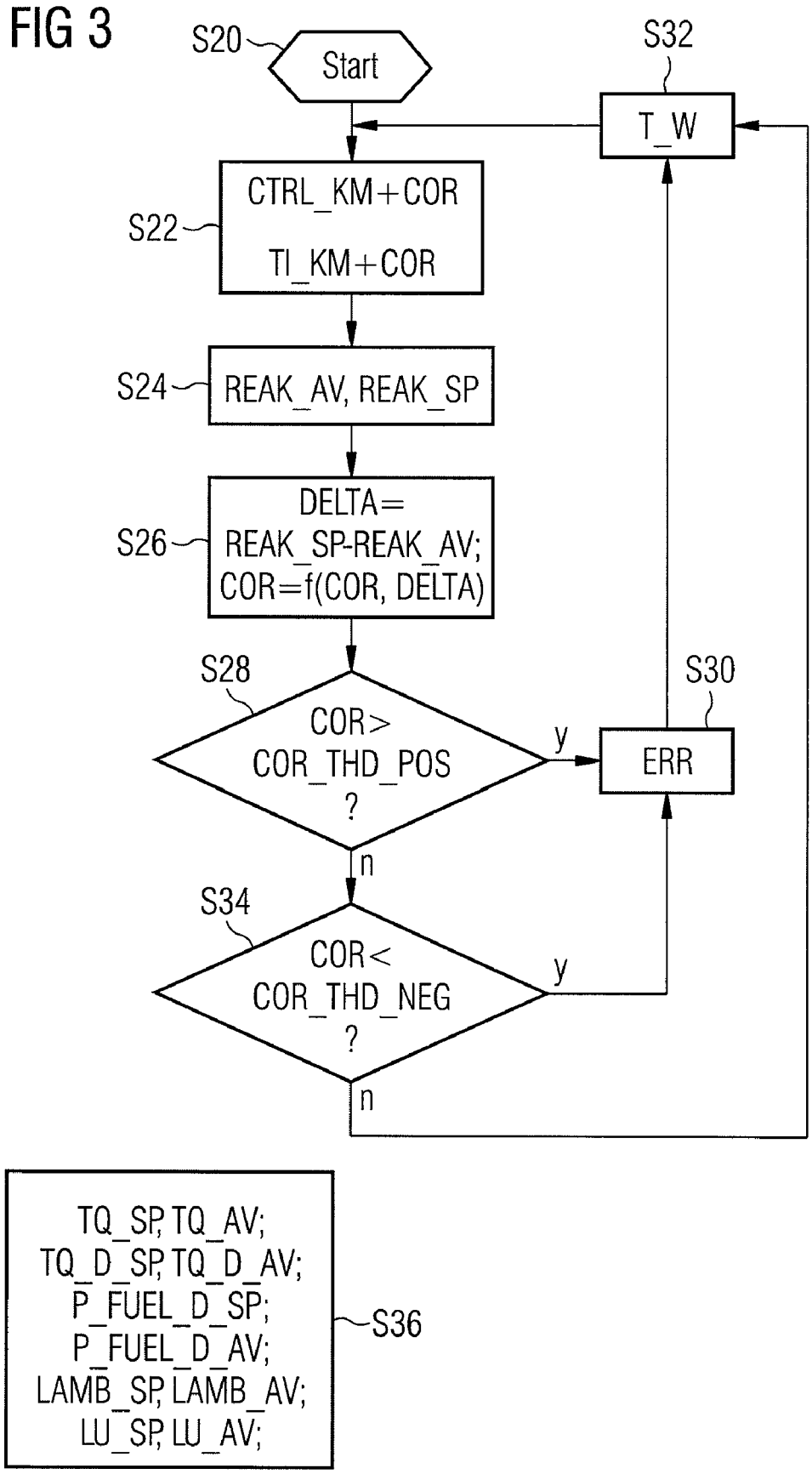
FIG. 3 shows a flow chart of a second program.

By executing the program of FIG. 2 or 3 outside the warming up period of the catalytic converter 21, the fault in the respective component that is affecting the exhaust gas in the respective cylinder can be easily detected, and can therefore have a particularly strong influence on the pollutant emissions during the warming up of the catalytic converter 21, since then the catalytic converter has not yet reached its operating temperature and the pollutants can be converted with only low efficiency.

REFERENCE NUMBERS

1 Induction tract
2 Engine block
3 Cylinder block
4 Exhaust gas tract
5 Throttle valve
6 Manifold
7 Induction manifold
8 Crankshaft
10 Connecting rod
11 Piston
12 Gas inlet valve
13 Gas exhaust valve
18 Injection valve
19 Spark plug
21 Catalytic converter
23 Supplementary catalytic converter
25 Control device
26 Pedal position transmitter
27 Gas pedal
28 Air mass sensor
32 First temperature sensor
34 Induction manifold pressure sensor
36 Crankshaft angle sensor
38 Second temperature sensor
39 Pressure sensor
42 Exhaust gas probe
N Rotational speed
Z1-Z4 Cylinder
CTRL_KM Control value of an actuating variable-minimum quantity
COR Correction value
REAK_SP Expected response value of a response variable
REAK_AV Actual response value of the response variable
DELTA Deviation
COR_THD_NEG Negative correction threshold value
COR_THD_POS Positive correction threshold value
ERR Fault in the respective injection valve
R_THD_NEG Negative response threshold
R_THD_POS Positive response threshold
TI_KM Injection time value
TQ_AV Actual torque value
TQ_SP Expected torque value
TQ_D_AV Actual torque change value
TQ_D_SP Expected torque change value
P_FUEL_D_AV Actual pressure change value
P_FUEL_D_SP Expected pressure change value
LAMB_AV Actual lambda value
LAMB_SP Expected lambda value
LU_AV Actual rough-running value
LU_SP Expected rough-running value
T_W Waiting time period

What is claimed is:

1. A method for operating an internal combustion engine having a plurality of cylinders, and injection valves assigned thereto for metering fuel into a combustion chamber of the respective cylinder, the method comprising the steps of:

actuating a respective injection valve at least once by at least one specified control value of an actuating variable for metering at least one specified minimum quantity corrected by a correction value, adjusting the correction value according to a deviation of an expected response value of a response variable from an actual response value of the response variable as a result of the actuation of the respective injection valve wherein the adjustment is effected by way of a reduction in the deviation between the expected response value of the response variable and the actual response value of the response variable, comparing the adjusted correction value to at least one of a specified negative correction threshold value and a specified positive correction threshold value, and based on the comparison, if the correction value undershoots the specified negative correction threshold value or overshoots the specified positive correction threshold value, detecting a fault in a component which is affecting the exhaust gas of the cylinder assigned to the respective injection valve.

2. The method according to claim 1, wherein the response variable represents a torque or a change of torque.

3. The method according to claim 1, wherein the response variable represents a pressure change in the fuel pressure in a fuel supply system of the injection valve.

4. The method according to claim 1, wherein the response variable represents an air/fuel ratio of a mixture in the respective cylinder, that is to say before the combustion of the mixture.

5. The method according to claim 1, wherein the response variable represents a rough-running value that is representative of a rough-running condition in a drive shaft of the internal combustion engine.

6. The method according to claim 1, wherein the specified actuating variable represents an injection time period.

7. The method according to claim 1, wherein the actuation of the injection valve by the specified control value or the specified control value corrected by means of the correction value, and the determination of the deviation take place in an overrun condition of the internal combustion engine.

8. The method according to claim 1, wherein the actuation of the injection valve by the specified control value or the specified control value corrected by means of the correction value, respectively, and the determination of the deviation take place in an idling condition.

9. A device for operating an internal combustion engine comprising a plurality of cylinders and injection valves assigned thereto for metering fuel into a combustion chamber of the respective cylinder, the device being operable to actuate the respective injection valve at least once by at least one specified control value of an actuating variable for metering at least one specified minimum quantity corrected by means of a correction value, to adjust the correction value according to a deviation of an expected response value of a response variable from an actual response value of the response variable as a result of the actuation of the respective injection valve, by way of a reduction of the deviation between the expected response value of the response variable and the actual response value of the response variable, to compare the adjusted correction value to at least one of a specified negative correction threshold value and a specified positive correction threshold value, and based on the comparison, if the correction value undershoots a specified negative correction threshold value or overshoots a specified positive correction threshold value, to detect a fault in a component which is affecting the exhaust gas of the cylinder assigned to the respective injection valve.

10. The device according to claim 9, wherein the response variable represents a torque or a change of torque.

11. The device according to claim 9, wherein the response variable represents a pressure change in the fuel pressure in a fuel supply system of the injection valve.

12. The device according to claim 9, wherein the response variable represents an air/fuel ratio of a mixture in the respective cylinder, that is to say before the combustion of the mixture.

13. The device according to claim 9, wherein the response variable represents a rough-running value that is representative of a rough-running condition in a drive shaft of the internal combustion engine.

14. The device according to claim 9, wherein the specified actuating variable represents an injection time period.

15. The device according to claim 9, wherein the actuation of the injection valve by the specified control value or the specified control value corrected by means of the correction value, and the determination of the deviation take place in an overrun condition of the internal combustion engine.

16. The device according to claim 9, wherein the actuation of the injection valve by the specified control value or the specified control value corrected by means of the correction value, respectively, and the determination of the deviation take place in an idling condition.

* * * * *